US006675965B2

(12) United States Patent
Holland et al.

(10) Patent No.: US 6,675,965 B2
(45) Date of Patent: Jan. 13, 2004

(54) TOOL POUCH WITH MAGNET IN THE POUCH

(75) Inventors: Matthew J. Holland, Baltimore, MD (US); Rickey J. Thomas, Manchester, MD (US); Michael P. Peters, Lutherville, MD (US)

(73) Assignee: Black & Decker Inc., Newark, DE (US)

( * ) Notice: Subject to any disclaimer, the term of this patent is extended or adjusted under 35 U.S.C. 154(b) by 98 days.

(21) Appl. No.: 09/866,043

(22) Filed: May 25, 2001

(65) Prior Publication Data

US 2002/0175100 A1 Nov. 28, 2002

(51) Int. Cl.[7] ..... A45C 11/04; B65D 85/24
(52) U.S. Cl. ..... 206/338; 206/818; 224/674
(58) Field of Search ..... 43/54.1, 57.1; 206/338, 349, 350, 372, 373, 818, 315.1; 224/183, 674; 383/95; 428/102

(56) References Cited

U.S. PATENT DOCUMENTS

| | | | | | |
|---|---|---|---|---|---|
| 2,283,543 | A | | 5/1942 | Draper et al. | |
| 2,475,450 | A | | 7/1949 | Dvorak | |
| 2,540,340 | A | * | 2/1951 | Linblade | 206/818 |
| 2,999,621 | A | * | 9/1961 | Kiser | 206/315.1 |
| 3,237,327 | A | * | 3/1966 | Griggs | 206/818 |
| 3,283,971 | A | * | 11/1966 | Jones | 224/183 |
| 3,704,991 | A | | 12/1972 | Leedy | |
| 3,747,258 | A | * | 7/1973 | Maciel | 43/57.1 |
| 3,831,743 | A | | 8/1974 | Leedy | |
| 3,861,434 | A | * | 1/1975 | Harding | 150/160 |
| 3,978,902 | A | * | 9/1976 | Adkinson | 206/38.1 |
| 4,033,013 | A | * | 7/1977 | Peterson | 383/95 |
| 4,058,209 | A | * | 11/1977 | Schmidt | 206/818 |
| 4,746,042 | A | * | 5/1988 | King | 224/674 |
| 4,826,059 | A | | 5/1989 | Bosch et al. | |
| 4,849,272 | A | * | 7/1989 | Haney et al. | 428/102 |
| 4,928,823 | A | | 5/1990 | Campbell | |
| 4,940,250 | A | * | 7/1990 | Corrado | 206/818 |
| 4,977,941 | A | | 12/1990 | Henderson | |
| 5,022,521 | A | | 6/1991 | Kane | |
| 5,097,947 | A | * | 3/1992 | Hsu | 206/818 |
| 5,460,305 | A | | 10/1995 | Ahearn | |
| 5,758,807 | A | | 6/1998 | Wright | |
| 6,024,277 | A | * | 2/2000 | Martin | 229/92.8 |
| 6,049,914 | A | | 4/2000 | Heilman | |
| 6,336,555 | B1 | * | 1/2002 | Breeden | 206/350 |

* cited by examiner

*Primary Examiner*—Jim Foster
(74) *Attorney, Agent, or Firm*—Harness, Dickey & Pierce, P.L.C.

(57) ABSTRACT

A tool pouch having a pocket with an opening to receive certain items. The pocket includes a magnetic member near the top of the pocket for holding items received in the pocket. The magnetic member assists in arranging items in the pocket.

1 Claim, 6 Drawing Sheets

TOOL POUCH WITH MAGNET IN THE POUCH

FIELD OF THE INVENTION

The present invention relates generally to tool pouches, and more particularly to a tool pouch with a magnetic member to position items in the pouch.

BACKGROUND

It is generally known in the art to produce tool pouches which are designed to suspend from a work belt and include pockets to hold items. The items generally are small tools and fasteners. Such items generally include sharp portions in addition to being small and relatively indistinguishable from one another.

Conventional tool pouch pockets include simple open areas into which small tools and fasteners are dropped. Therefore, to retrieve an item, the user of the tool pouch must place a hand into a pocket for the desired item. This haphazard retrieval may produce detrimental effects. For example, the user must look or search for the item which is desired, especially if more than one of a particular type of fastener or tool is in the pocket. This wastes time and effort.

Thus, it would be advantageous to have a system from which small tools and fasteners may be removed with minimal effort. In this way, the user would not be required to search around in the pocket in the attempt to find the item.

SUMMARY OF THE INVENTION

The present invention provides an apparatus and method for removing small fasteners and tools from the pockets of tool pouches while not requiring the user to search within the pocket. In particular, a magnetic member is disposed adjacent the top of a pocket of the tool pouch. Fasteners in the pocket are attracted and affixed to the magnetic member in the tool pouch. In addition, the pouch itself may be periodically jostled so that a small portion of the items located in the pocket reach the magnetic member and adhere thereto.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
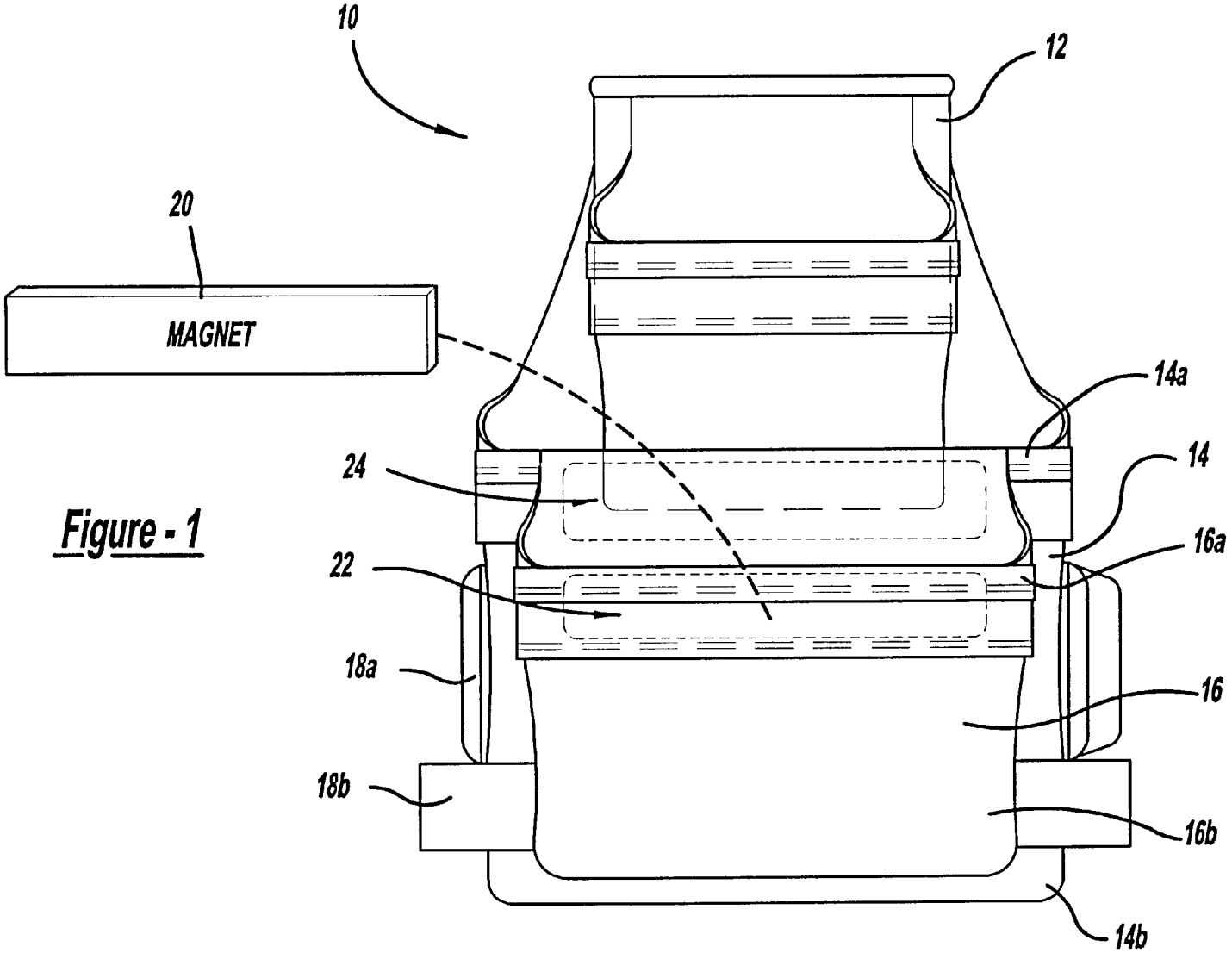
FIG. 1 is a front view of the tool pouch including areas for the insertion of the magnetic portion.

With reference to FIG. 1, a tool pouch 10 is illustrated including a belt loop 12 for receiving a belt worn about the waist of a worker, a first pocket 14, and a second pocket 16. However, it is to be understood this is merely exemplary and a tool pouch may offer only one pocket or multiple pockets of a number greater than two. Tool pouch 10 also includes other fixtures 18*a*, 18*b* designed to accept tools and devices. Small items, such as fasteners (See FIG. 8) are generally placed within the pockets 14, 16 and fall from the top of the pockets 14*a*, 16*a* towards the bottom of the pockets 14*b*, 16*b* due to gravity.

A magnetic member 20 is placed into as many or as few pockets of the tool pouch 10 as desired by the manufacturer or user. The magnetic member 20 may be affixed to either the back or front of the pocket or both. Preferably, the magnetic member 20 is affixed adjacent the tops 14*a*, 16*a* of the respective pockets 14, 16, regardless of whether the magnetic member 20 is affixed to the back or front of the pocket 14, 16. Thus, the magnetic member 20 is preferably affixed in the areas outlined by dashed portions 22, 24.

Preferably, the magnetic member 20 does not extend to the bottom 14*b*, 16*b* of the pockets 14, 16. Rather the dimensions of the tops 14*a*, 16*a* of the pockets 14, 16 dictate the outer dimensions of the magnetic member 20. Thus, fasteners are not held near the bottom of the pockets 14*b*, 16*b* by the magnetic member 20. As an example, if a pocket of a tool pouch is approximately 16 cm in depth, the preferred magnetic member would be approximately 3 cm deep. Furthermore, the magnetic member 20 generally resides entirely within the pocket 14, 16 and does not extend a great distance above the pocket. Thus, the fasteners remain in the pocket 14, 16 even if dislodged from the magnetic member 20. The general dimensions of the magnetic member 20 may differ and this is exemplary only. It will be understood also that the exact placement of the magnetic member 20 may vary although preferably it is contiguous to the top portion of the pocket.

Figure 2:
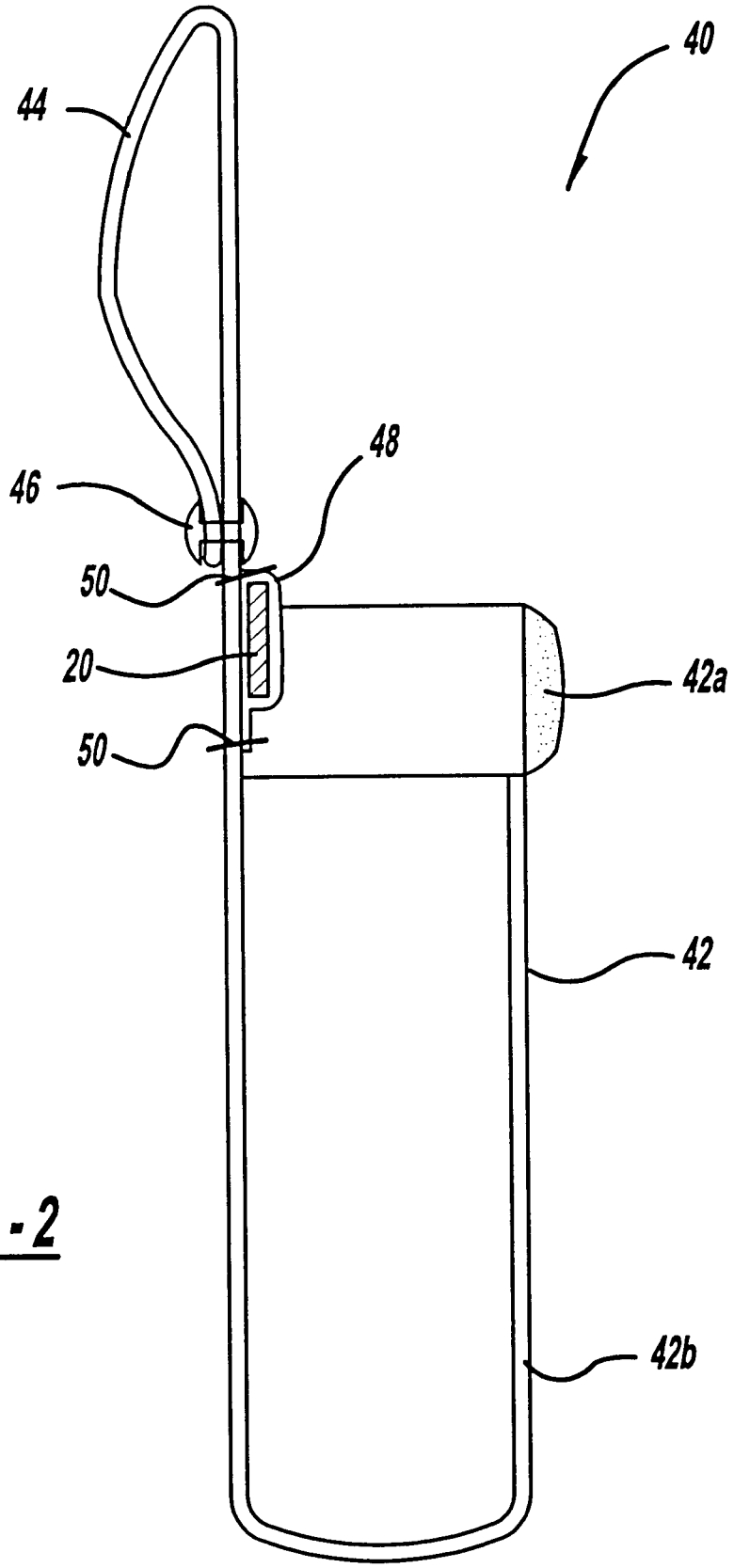
FIG. 2 is a cross-sectional view of a tool pouch including a magnetic insert according to the first embodiment.

With reference to FIG. 2, a second illustrative tool pouch 40 is shown. This second tool pouch 40 includes a single pocket 42 with an upper region 42*a* and a lower region 42*b*. It may also be seen that a single piece of material forms the belt loop 44 of the tool pouch 40 where the material is looped upon itself and affixed in place with a rivet 46 or other suitable means.

The magnetic member 20 is affixed in place with a portion of material 48 that extends around and is affixed to the top of the pocket 42*a* with stitching 50 or other acceptable devices. In this way, the magnetic member 20 remains adjacent to the top of the pocket 42*a* and is held there for use.

Using a portion of material 48 according to this first embodiment is particularly useful when the magnetic member 20 is stiff. However, the material 48 must be both durable enough to hold the magnetic member 20 in place during usage, but also thin enough to allow the magnetic field of the magnetic member 20 to be effective.

Figure 3:
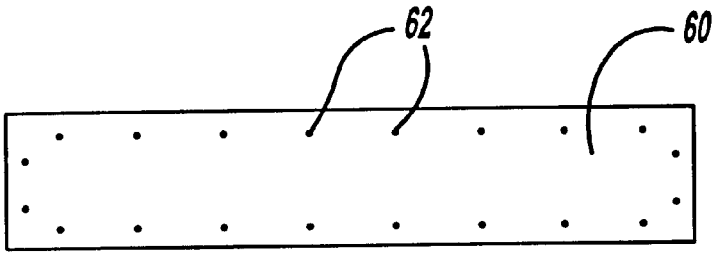
FIG. 3 is a top view of a second embodiment of a magnetic member insert according to the present invention.

With reference to FIG. 3, a second embodiment of the magnetic member 60, includes a plurality of bores 62 formed through the magnetic member 60. In the second embodiment, the magnetic member 60 is preferably formed of a flexible material that creates a magnetic field. However, it is also possible to form the bores 62 through a rigid magnetic material and still achieve a similar effect.

According to the second embodiment, stitching or other fastening means are passed through the bores 62 to affix the magnetic member 60 to the tool pouch. Furthermore, the flexible nature of the preferred material of the magnetic member 60 allows it to conform to the wearer or the stiffened portion of the tool pouch 10, 40. In this way, comfort of use is increased as opposed to placing a stiff magnetic member at the upper ends of the pocket.

Figure 4:
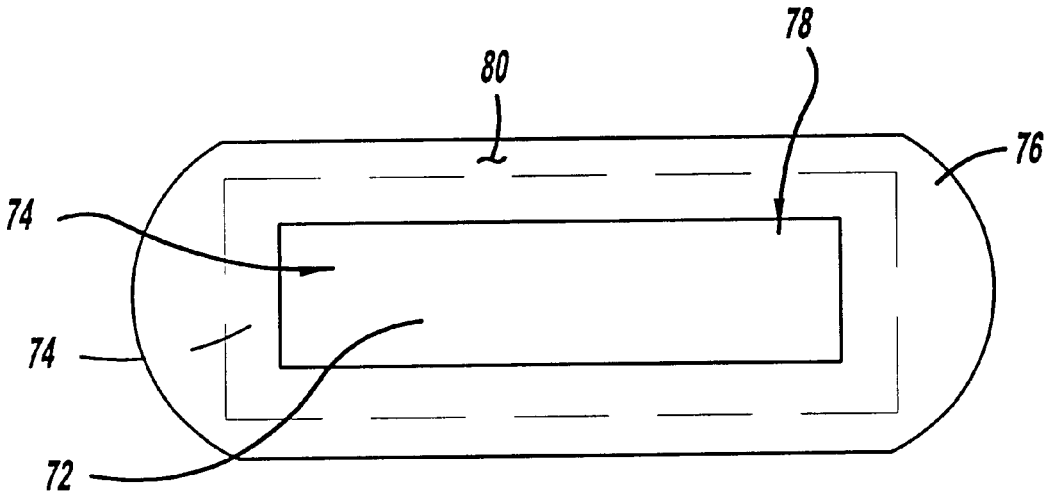
FIG. 4 is a top view of a third embodiment of the magnetic insert according to the present invention.
Figure 5:
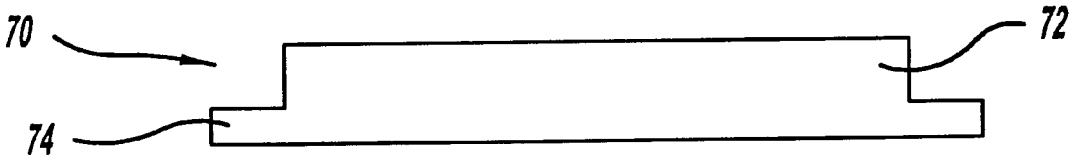
FIG. 5 is a side view of the third embodiment of the magnetic insert including a material portion to affix the magnetic insert to a pouch according to the present invention.

With reference to FIGS. 4 and 5, a third embodiment of the magnetic member 70 is shown. In the third embodiment, the magnetic member 70 includes a main body portion 72 and a flange region 74 surrounding the main body portion 72. A material portion 76, including an opening 78, overlays the magnetic member 70 and includes a collar region 80 for stitching or otherwise affixing the material portion 76 to a pouch 10, 40. The opening 78 allows the exposure of the main body portion 72 of the magnetic member 70, while the flange region 74 is trapped under the collar region 80. Items may be affixed to the magnetic member 70 by placing them near the main body portion 72 which is affixed by material portion 76. The third embodiment may include either a flexible magnetic member or a stiff magnetic member. Preferably, a flexible magnetic member would still be used to allow the magnetic member to form to the body of the user or to the shape of the tool pouch 10, 40.

Figure 6:
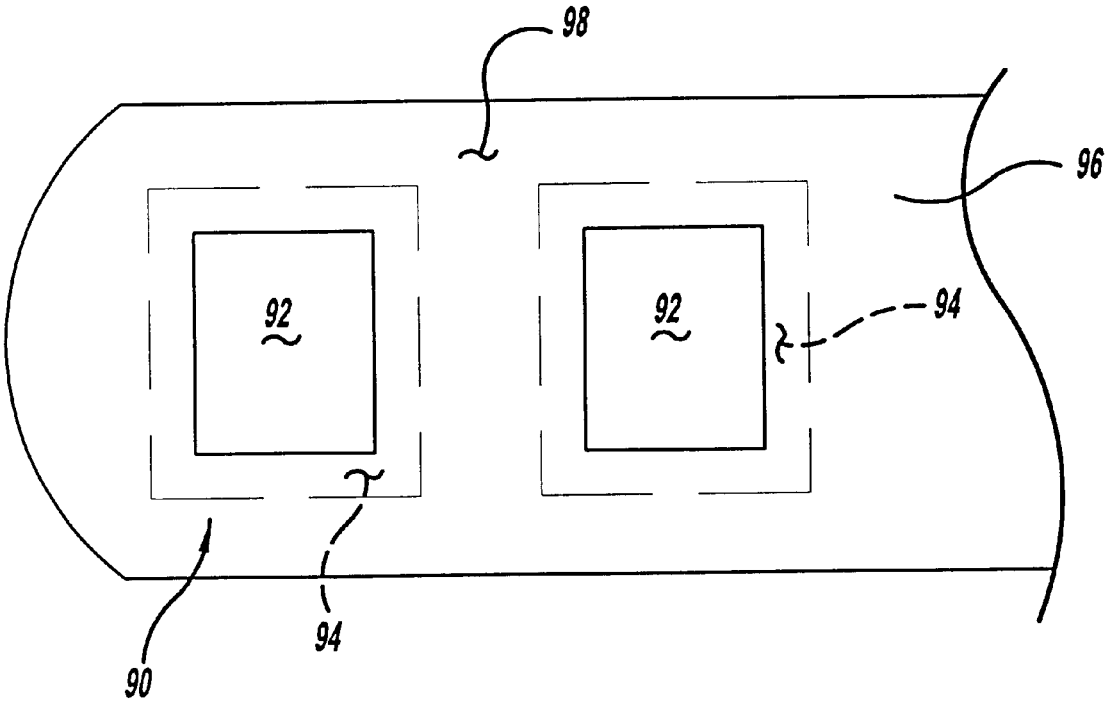
FIG. 6 is a plan view of a fourth embodiment of the magnetic insert including a material portion to affix the magnetic insert to a pouch according to the present invention.

With reference to FIG. 6, a fourth embodiment of the invention is shown. The magnetic members 90 of the fourth embodiment are similar to the magnetic member 70 of the third embodiment in FIGS. 4 and 5. For example, the magnetic members 90 includes a main body 92 and a flange 94 which is covered by a material portion 96 including a collar 98 for allowing it to be affixed to a tool pouch 10, 40. The magnetic members 90 are smaller than the magnetic members 70, discussed above, and a plurality of magnetic members 90 are spaced apart in a single pocket. Therefore, even though an individual magnetic member 90 may be formed of a rigid or stiff material, the entire magnetic portion flexes between the individual magnetic members 90 which allows it to form to either the user's body or the tool pouch itself. Further, the main body portion 92 of each magnetic member 90 is still exposed to receive any items that may be affixed to it.

Figure 7:
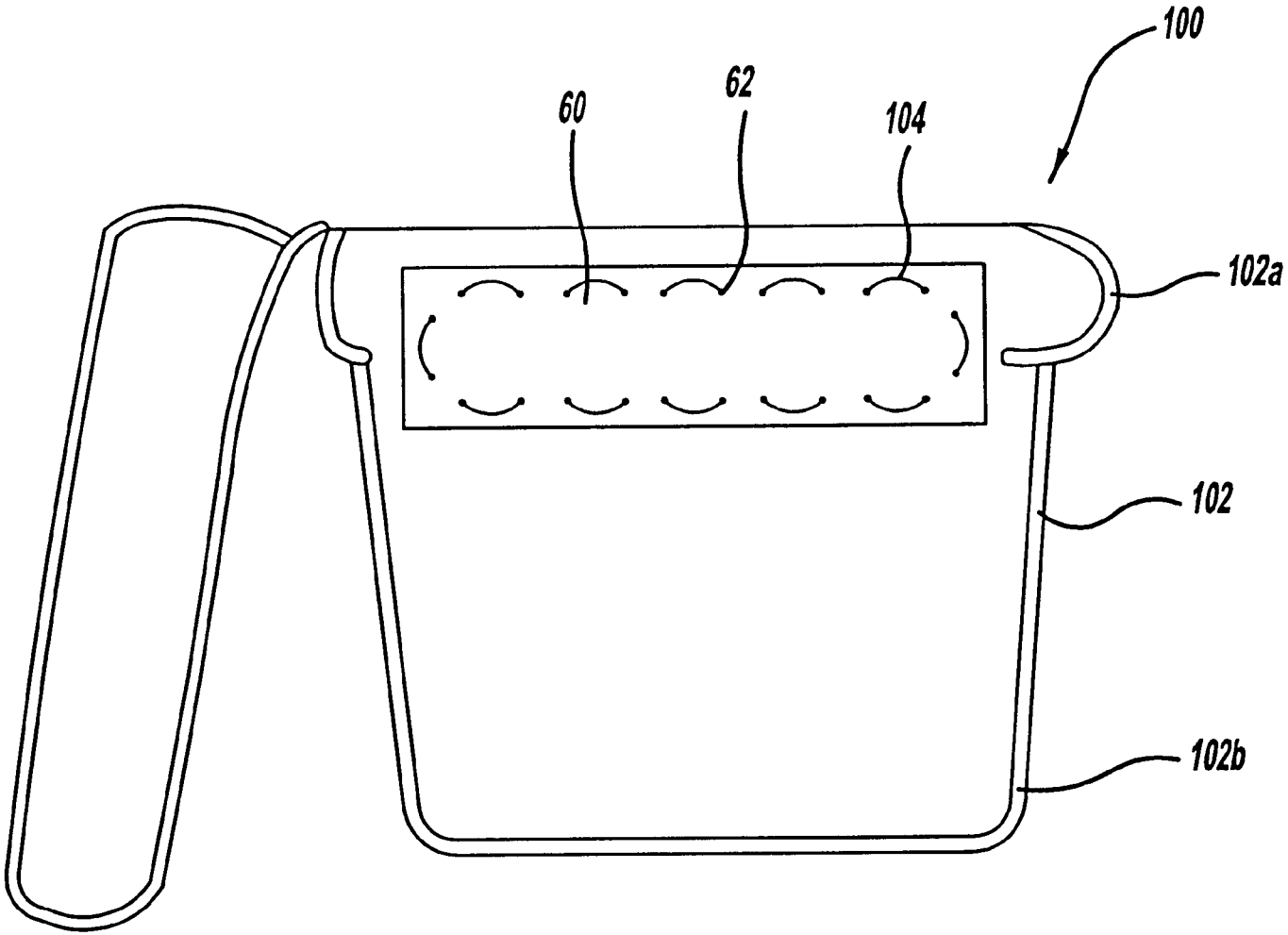
FIG. 7 is a cross-sectional view of a bag including a magnetic member according to the present invention.

With reference to FIG. 7, a tool bag 100 is shown. A magnetic member 60, like that disclosed in the second embodiment (in FIG. 3), is shown affixed to the tool bag 100. Here, the tool pouch 102 of the tool bag 100 includes an upper portion 102*a* and a lower portion 102*b*. The magnetic member 60 includes bores 62 therethrough. Stitching 104 affixes the magnetic member 60 to the upper portion 102*a* of the pocket 102.

In this embodiment, though the tool bag 100 is not worn on the body of a user, a magnetic member 60 still assists in the removal and placement of items. The magnetic member 60 is preferably formed of a flexible material so as to conform to the contours of the upper portion of 102*a* of the pocket 102. This is particularly useful if the bag happens to include rounded edges or curved sides so that the magnetic member 60 may remain continuous along the upper edges 102*a* of the pocket 102.

Figure 8:
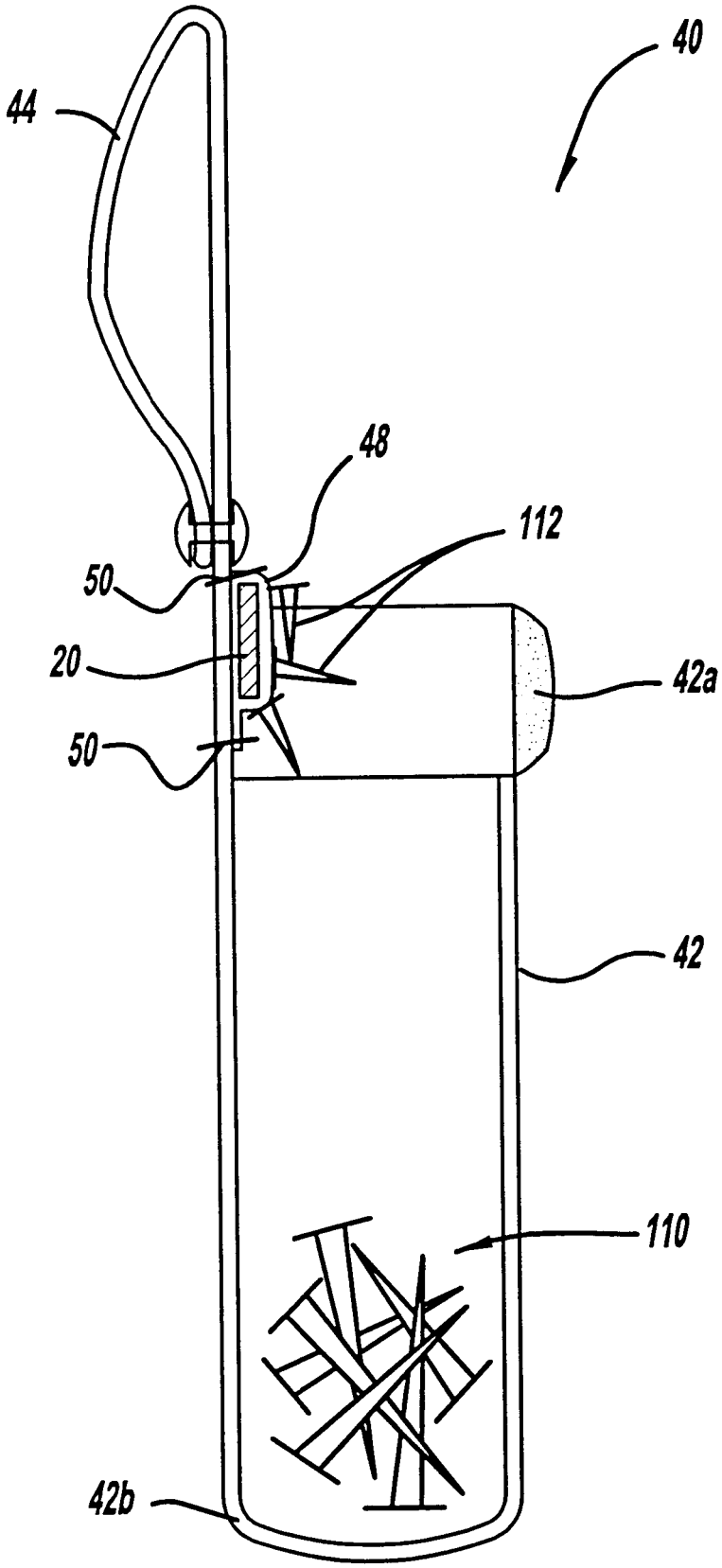
FIG. 8 is a cross-sectional view similar to FIG. 2 but also including exemplary fasteners.

With reference to FIGS. 2 and 8, and with particular reference to FIG. 8, where like numerals indicate like elements, an example of the use of the present invention is shown. The magnetic member 20 is affixed to the back of the pocket 42 adjacent the top 42*a* of the pocket 42. Fasteners 110 filling a portion of the pocket 42 are shown. A second set of fasteners 112 are affixed to the magnetic member 20. Therefore, the user only need reach far enough into the pocket to reach the second set of fasteners 112 adjacent the top 42*a* of the pocket as opposed to the user reaching into the bottom 42*b* of the pocket 42 where the first set of fasteners 110 are simply laying about.

The second set of fasteners 112 affixed to the magnetic member 20 of the tool pouch 40 may become adhered to the magnetic member 20 through several means. For example, a user of the tool pouch may jostle the pouch 40 when fasteners 110 are simply lying in the bottom 42*b* of the pocket 42. If the pouch 40 is jostled enough, fasteners 110 will come in range of the magnetic field produced by the magnetic member 20. Once this occurs, the fasteners 110 will adhere to the magnetic member 20 such as the second set of fasteners 112. Second, a user may simply place fasteners next to the magnetic member 20 thereby affixing them to the magnetic member 20. In either case, fasteners are then held at the top 42*a* of the pocket 42 where the user may easily see and reach them. This reduces frustration during the use of a tool pouch 40 and increases efficiency.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fastener pouch for a tool belt comprising:

a pocket including front, back, side, and bottom sections defining a cavity, said cavity including an opening;

a belt loop extending upwardly from said back section;

a magnetic retaining member attached to said back section, said retaining member disposed at said opening and away from the bottom section, the magnetic force of said retaining member being sufficient to hold fasteners within the cavity near said opening and away from said bottom section.

* * * * *